US008483014B2

(12) United States Patent
Huang

(10) Patent No.: US 8,483,014 B2
(45) Date of Patent: Jul. 9, 2013

(54) MICROMACHINED ULTRASONIC TRANSDUCERS

(75) Inventor: Yongli Huang, San Jose, CA (US)

(73) Assignee: Kolo Technologies, Inc., San Jose, CA (US)

( * ) Notice: Subject to any disclaimer, the term of this patent is extended or adjusted under 35 U.S.C. 154(b) by 758 days.

(21) Appl. No.: 12/327,806

(22) Filed: Dec. 3, 2008

(65) Prior Publication Data

US 2009/0140609 A1 Jun. 4, 2009

Related U.S. Application Data

(60) Provisional application No. 60/992,020, filed on Dec. 3, 2007, provisional application No. 60/992,032, filed on Dec. 3, 2007.

(51) Int. Cl.
*H04R 19/00* (2006.01)

(52) U.S. Cl.
USPC ..... 367/181; 381/174

(58) Field of Classification Search
USPC ..... 367/181; 381/174
See application file for complete search history.

(56) References Cited

U.S. PATENT DOCUMENTS 5,161,200 A * 11/1992 Barr ..... 381/173
6,328,696 B1 * 12/2001 Fraser ..... 600/459
7,493,821 B2 * 2/2009 Wang ..... 73/718
7,612,483 B2 * 11/2009 Degertekin ..... 310/309
7,615,834 B2 * 11/2009 Khuri-Yakub et al. ..... 257/416

* cited by examiner

*Primary Examiner* — Ian Lobo
(74) *Attorney, Agent, or Firm* — Lee & Hayes, PLLC

(57) ABSTRACT

A capacitive micromachined ultrasonic transducer (CMUT) includes a structured membrane which possesses improved frequency response characteristics. Some embodiments provide CMUTs which include a substrate, a first electrode, a second movable electrode, and a structured membrane. The movable second electrode is spaced apart from the first electrode and is coupled to the structured membrane. The structured membrane is shaped to possess a selected resonant frequency or an optimized frequency response. The structured membrane can include a plate and a beam coupled to the plate such that the resonant frequency of the structured membrane is greater than the resonant frequency of the plate. Furthermore, the ratio of the resonant frequency of the structured membrane over the mass of the structured membrane can be greater than the ratio of the resonant frequency of the plate over the mass of the plate. In some embodiments, the CMUT is an embedded spring ESCMUT.

28 Claims, 12 Drawing Sheets

MICROMACHINED ULTRASONIC TRANSDUCERS

PRIORITY

This application claims priority from U.S. Provisional Applications Ser. No. 60/992,020, filed Dec. 3, 2007 and U.S. Provisional Applications Ser. No. 60/992,032, filed Dec. 3, 2007.

BACKGROUND

The present disclosure relates to micromachined ultrasonic transducers (MUT) and, more particularly, to capacitive micromachined ultrasonic transducers (CMUTs).

Capacitive micromachined ultrasonic transducers (CMUTs) are electrostatic actuator/transducers, which are widely used in various applications. Ultrasonic transducers can operate in a variety of media including liquids, solids and gas. These transducers are commonly used for medical imaging for diagnostics and therapy, biochemical imaging, non-destructive evaluation of materials, sonar, communication, proximity sensors, gas flow measurements, in-situ process monitoring, acoustic microscopy, underwater sensing and imaging, and many others. In addition to discrete ultrasound transducers, ultrasound transducer arrays containing multiple transducers have been also developed. For example, two-dimensional arrays of ultrasound transducers are developed for imaging applications.

Compared to the widely used piezoelectric (PZT) ultrasound transducer, the MUT has advantages in device fabrication method, bandwidth and operation temperature. For example, making arrays of conventional PZT transducers involves dicing and connecting individual piezoelectric elements. This process is fraught with difficulties and high expenses, not to mention the large input impedance mismatch problem presented by such elements to transmit/receiving electronics. In comparison, the micromachining techniques used in fabricating MUTs are much more capable in making such arrays. In terms of performance, the MUT demonstrates a dynamic performance comparable to that of PZT transducers. For these reasons, the MUT is becoming an attractive alternative to the piezoelectric (PZT) ultrasound transducers.

The basic structure of a CMUT is a parallel plate capacitor with a rigid bottom electrode and a top electrode residing on or within a flexible membrane, which is used to transmit (TX) or detect (RX) an acoustic wave in an adjacent medium. A DC bias voltage is applied between the electrodes to deflect the membrane to an optimum position for CMUT operation, usually with the goal of maximizing sensitivity and bandwidth. During transmission an AC signal is applied to the transducer. The alternating electrostatic force between the top electrode and the bottom electrode actuates the membrane in order to deliver acoustic energy into the medium surrounding the CMUT. During reception the impinging acoustic wave vibrates the membrane, thus altering the capacitance between the two electrodes. An electronic circuit detects this capacitance change.

Two representative types of CMUT structures are the flexible membrane CMUT and the recently introduced embedded-spring CMUT (ESCMUT) types of CMUTs. FIG. 1 shows a schematic cross-sectional view of a conventional flexible membrane CMUT 100, which has a fixed substrate 101 having a bottom electrode 120, a flexible membrane 110 connected to the substrate 101 through membrane supports 130, and a movable top electrode 150. The flexible membrane 110 is spaced from the bottom electrode 120 by the membrane supports 130 to form a transducing space 160 (which may be sealed for immersion applications). It will be understood that certain components of CMUT 100 may be formed from materials which are electrical insulators. For instance, membrane supports 130 can be insulators thereby providing electrical isolation between flexible membrane 110 and/or top electrode 150 and bottom electrode 120. Moreover, while not shown, CMUT 100 can include various insulating layers to isolate certain other components of CMUT 100 as may be deemed desirable.

FIG. 2 is a schematic cross-sectional view of embedded-spring CMUT (ESCMUT) 200, which is described in the PCT International Application No. PCT/IB2006/051568, entitled MICRO-ELECTRO-MECHANICAL TRANSDUCERS, filed on May 18, 2006; and International Application (PCT) No. PCT/IB2006/051569, entitled MICRO-ELECTRO-MECHANICAL TRANSDUCERS, filed on May 18, 2006, particularly the CMUTs shown in FIGS. 5A-5D therein. The CMUT 200 has a substrate 201, a spring anchor 203, a spring layer 210 supported on the substrate by the spring anchor 203; a surface plate 240 connected to the spring layer 210 through spring-plate connectors 230; and a top electrode 250 connected to the surface plate 240. The CMUT 200 may be only a portion of a complete CMUT element (not shown). The CMUT 200 can have one movable plate or multiple plates supported by embedded spring members.

In some embodiments, the membrane in a CMUT shown in FIG. 1 and the surface plate of an ESCMUT shown in FIG. 2 should be made of light and stiff material (a material with a low density and a high Young's Modulus). If a material with certain mass density and Young's modulus is chosen as the membrane or surface plate material, then an enhanced structure for the membrane or surface plate can be fabricated to make the membrane or surface plate light and rigid, thereby improving device performance.

SUMMARY

This application discloses capacitive micromachined ultrasonic transducers (CMUTs) which include membranes or surface plates with enhanced structural designs to provide improved frequency response characteristics for the CMUTs.

Some embodiments provide CMUTs which include a substrate, a first electrode, a second movable electrode, and a structured membrane. The movable second electrode is spaced apart from the first electrode and is coupled to the structured membrane. Moreover, the structured membrane is shaped to possess a selected resonant frequency. In various embodiments, the structured membrane includes a plate and a beam coupled to the plate such that the resonant frequency of the structured membrane is greater than the resonant frequency of the plate. Furthermore, the ratio of the resonant frequency of the structured membrane over the mass of the structured membrane can be greater than the ratio of the resonant frequency of the plate over the mass of the plate. The structured membrane can include a second beam which intersects the first beam and is also coupled to the plate.

Various embodiments provide CMUTs in which the first beam extends partially across the plate. Moreover, the first beam can define a void. In some embodiments, the plate and the first beam are the same shape with the beam being smaller than the plate. The thickness of the first beam can be greater than the thickness of the plate and can be greater than the width of the first beam. Moreover, some embodiments provide CMUTs with structured membranes having a pattern of beams coupled to the plate.

Embodiments provide advantages over previously available CMUTs. More specifically, CMUTs with structured membranes and correspondingly improved frequency response characteristics. Some embodiments provide CMUTs with higher maximum operating frequencies and wider bandwidths than those of previously available CMUTs. Thus, various CMUTs disclosed herein can perform a wider variety of procedures than previously available CMUTs while also providing improved sensitivity, accuracy, and precision.

DETAILED DESCRIPTION

Figure 1:
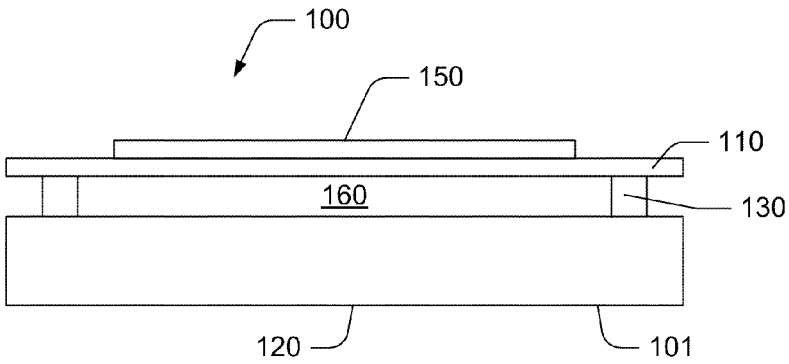
FIG. 1 (prior art)
FIG. 1 is a schematic cross-sectional view of a conventional flexible membrane CMUT.

Micromachined ultrasonic transducers with structured membranes and correspondingly improved frequency response characteristics are described in detail along with the figures, in which like parts are generally denoted with like reference numerals and letters.

It has been found that stiff and light CMUT membranes provide better performance and, more particularly, better frequency response characteristics than more flexible, heavier membranes. Thus, ideally, the flexible membrane 110 in the CMUT 100 shown in FIG. 1 and the surface plate 240 of the ESCMUT shown in FIG. 2 (hereinafter "membranes") should be made of materials with low densities and high Young's Moduli so that these membranes are both stiff and light. Given a particular membrane material (and density), further optimization of CMUT performance can be achieved by structuring the membrane as is described herein. More particularly, the structure of the membrane can be enhanced to optimize the membrane's stiffness for a given equivalent mass of the membrane.

Two parameters associated with the frequency response characteristics of a MUT are its acoustic impedance and its resonant frequency. Usually, it is desired for the acoustical impedance to be low, for a given operating frequency region, so that a wide bandwidth can be achieved (especially for, but not limited to, high frequency MUTs). Mathematically, a CMUT membrane can be represented as a mass and spring system in which m represents the equivalent mass of the membrane, k represents the equivalent spring constant of the membrane, and $f_0$ represents the resonant frequency of the membrane in a vacuum. The resonant frequency can be determined from the equivalent spring constant k and equivalent mass m as follows:

$$f_0=2\pi sqrt(k/m)$$

The acoustic impedance $Z_m$ of the membrane can also be determined as follows:

$$Zm=j(m2\pi f-k/2\pi f)$$

In the alternative, substituting for the spring rate k, the acoustic impedance $Z_m$ of the MUT can be determined as follows:

$$Zm=j2\pi m(f-f_0^2/f)$$

Thus, for a membrane with designed resonant frequency $f_0$, a membrane with a lower equivalent mass m can be designed to possess a low acoustic impedance Zm. Or, for a given equivalent mass m, a membrane with a higher resonant frequency can be designed to posses a lower acoustic impedance. Therefore, optimizing the ratio of the resonant frequency $f_0$ over the equivalent mass m can yield CMUTs with better frequency response characteristics. Accordingly, one aspect of the disclosure is the use of the ratio $f_0/m$ of the resonant frequency $f_0$ over the equivalent mass m as a guide in evaluating the merit of various membrane designs. In some embodiments, other suitable ratios could be used as a guide in evaluating various membrane designs. For instance, instead of mass m, the equivalent mass or mass density of the membranes could be used in the ratio. Accordingly, in various embodiments, CMUT membrane can be designed to achieve an improved ratio $f_0/m$ of resonant frequency $f_0$ over equivalent mass m.

Figure 2:
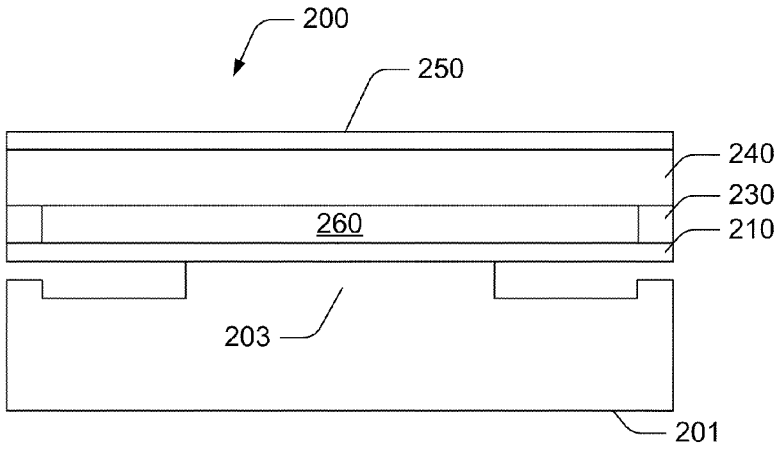
FIG. 2 (prior art)
FIG. 2 is a schematic cross-sectional view of an embedded-spring CMUT (ESCMUT).
Figure 3A:
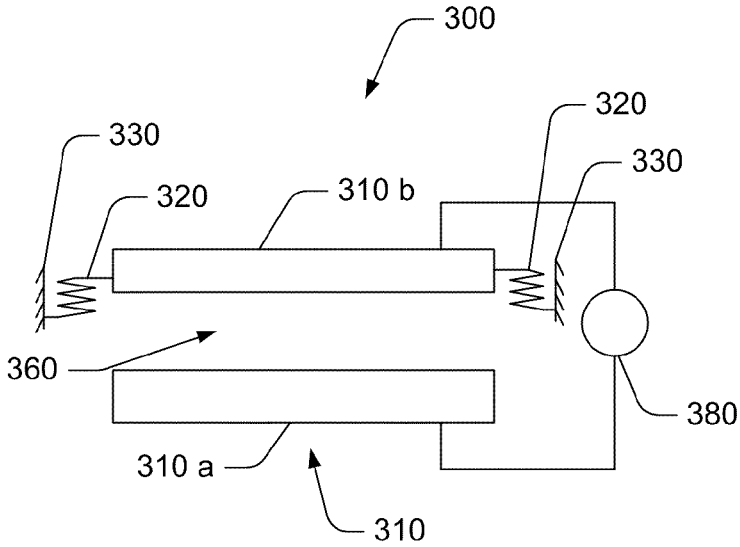
FIG. 3A shows a simplified schematic CMUT model.
Figure 3B:
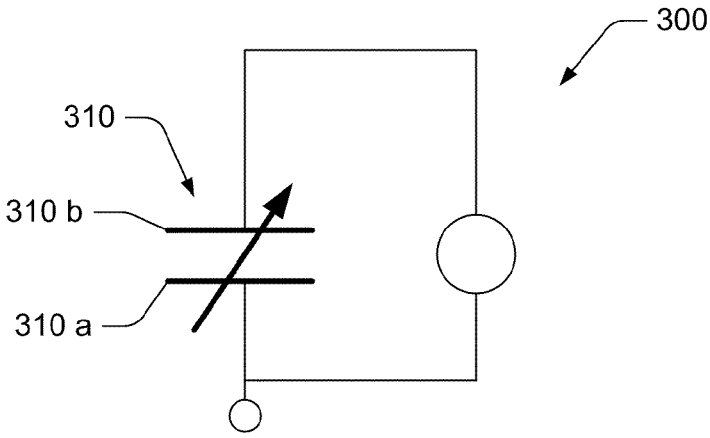
FIG. 3B shows a further simplified circuit model having a variable capacitor representing a CMUT.
Figure 4:
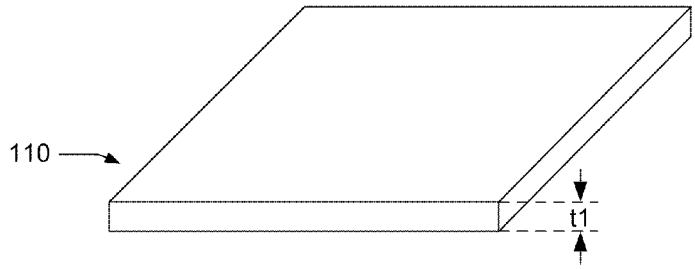
FIG. 4 shows a perspective view of a membrane of a CMUT.

With reference again to FIG. 1, a conventional capacitive micromachined ultrasonic transducer (CMUT) is illustrated. While only one CMUT 100 is shown, it will be understood that CMUT 100 could be one element of an array of CMUTs. More particularly, FIG. 1 shows that the flexible membrane 110 of CMUT 100 has a uniform thickness and cross section. As further illustrated in FIG. 4, the flexible membrane 110 is a square plate of uniform thickness $t_1$. While FIG. 4 illustrates the flexible membrane 110 as being square, membranes of other shapes are within the scope of the disclosure. For instance, the flexible membrane 110 could be circular.

The second resonant frequency $f_2$ of the CMUTS limits the bandwidth of the output of those CMUTs. Some approaches to achieving a second resonant frequency that is well separated from the first resonant frequency $f_0$ have used so called "piston" membranes. These piston membranes are shaped somewhat like a piston with a thinner portion and a thicker portion and tend to improve the separation between the first resonant frequency $f_0$ and second resonant frequency $f_2$ of the piston membranes 410.

Figure 5:
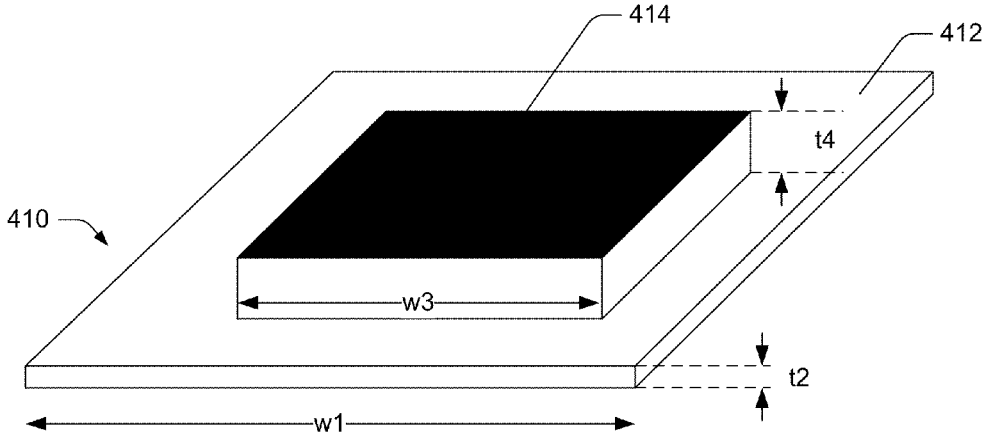
FIG. 5 shows a perspective view of a piston membrane of a CMUT.
Figure 6:
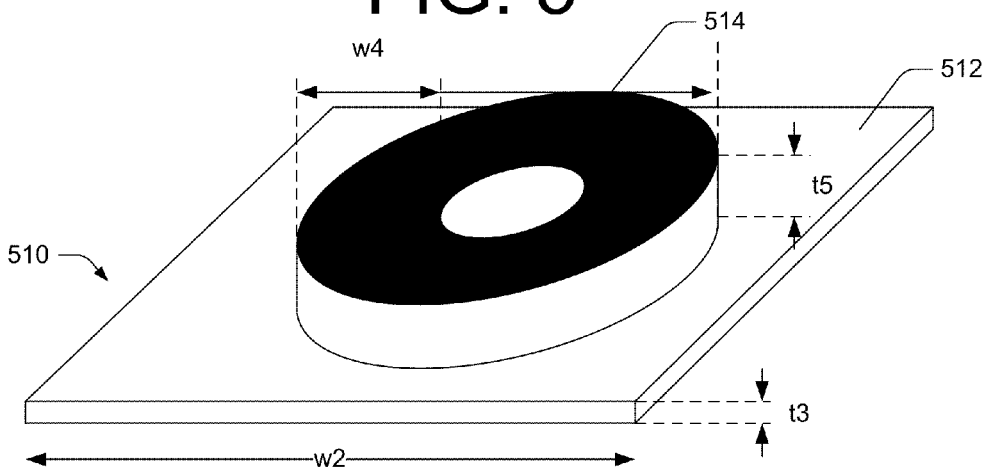
FIG. 6 shows a perspective view of another piston membrane of a CMUT.

With reference now to FIGS. 5 and 6, two piston membranes 410 and 510 are illustrated. More particularly, FIG. 5 illustrates a square piston membrane 410 while FIG. 6 illustrates a circular piston membrane 510. Each of the illustrated piston membranes 410 and 510 includes thinner portion 412 and 512, respectively, which anchor the piston membranes 410 and 510 to the membrane supports 130 (see FIG. 1) and extend there between. Thinner portions 412 and 512 have uniform thicknesses t2 and t3, respectively. Each of the illustrated piston membranes 410 and 510 also includes relatively thicker portions 414 and 514. Thicker portions 414 and 514 can reside on either the side of the thinner portions 412 and 512 which faces transducing space 160 (see FIG. 1) or on the side of thinner portions 412 and 512 facing away from transducing space 160. Thicker portions also have uniform thicknesses $t_4$ and $t_5$.

As illustrated in FIGS. 5 and 6, thinner portions 412 and 512 and thicker portions 414 and 514, respectively, can have shapes which correspond to each other. For example, thinner portion 412 and thicker portion 414 can both be square. However, thinner portions 412 and 512 and thicker portions 414 and 514 could have differing shapes. Thinner portions 412 and 512 also have widths $w_1$ and $w_2$ (or other dimensions), respectively, which are indicative of their overall size. Thicker portions 414 and 514 also have widths $w_3$ and $w_4$ (or other dimensions) indicative of their overall size. Thicker portions 414 and 514 can be smaller in size than thinner portions 412 and 512 as illustrated by the difference between thinner portion widths $w_1$ and $w_2$ and thicker portion widths $w_3$ and $w_4$.

Again, as discussed previously, the configuration of piston membranes 410 and 510 improve the separation between the first resonant frequency $f_0$ and the second resonant frequency $f_2$ of the piston membranes 410 and 510. Thus, piston membranes 410 and 510 do not optimize the ratio $f_0/m$ of resonant frequency $f_0$ over equivalent mass m. Indeed, optimizing the separation between the first resonant frequency $f_0$ and the second resonant frequency $f_2$ could adversely affect the ratio $f_0/m$ of resonant frequency $f_0$ over equivalent mass m. For instance, depending on the thicknesses t4 and t5 and widths $w_3$ and $w_4$ of thicker portions 414 and 514, the ratio of the resonant frequency $f_0$ over the equivalent mass m could decrease thereby yielding a less desirable piston membrane 410 and 510 (as evaluated using the ratio $f_0/m$ of resonant frequency $f_0$ over mass m). More particularly, it is unlikely that a piston membrane 410 or 510 with uniform thinner portions 412 and 512 and uniform thicker portions 414 and 514 could optimize the ratio $f_0/m$ of the resonant frequency $f_0$ over the equivalent mass m (or achieve a selected ratio of resonant frequency $f_0$ over mass m).

Figure 7:
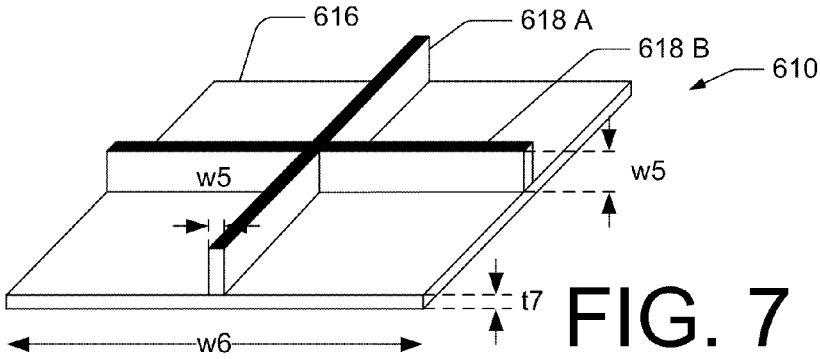
FIG. 7 shows a perspective view of a structured membrane of a CMUT.
Figure 8:
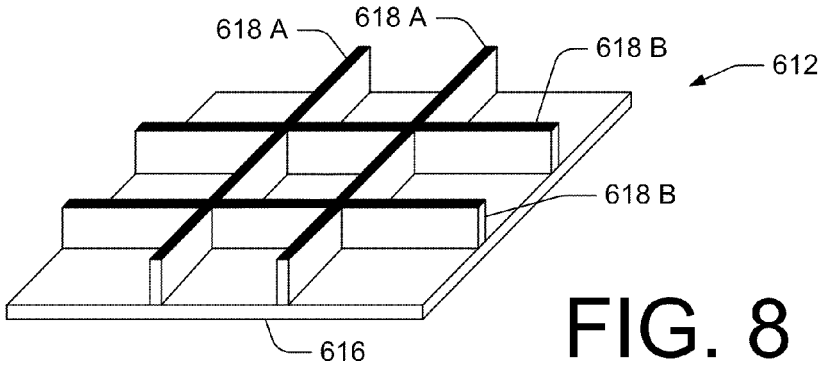
FIG. 8 shows a perspective view of another structured membrane of a CMUT.
Figure 9:
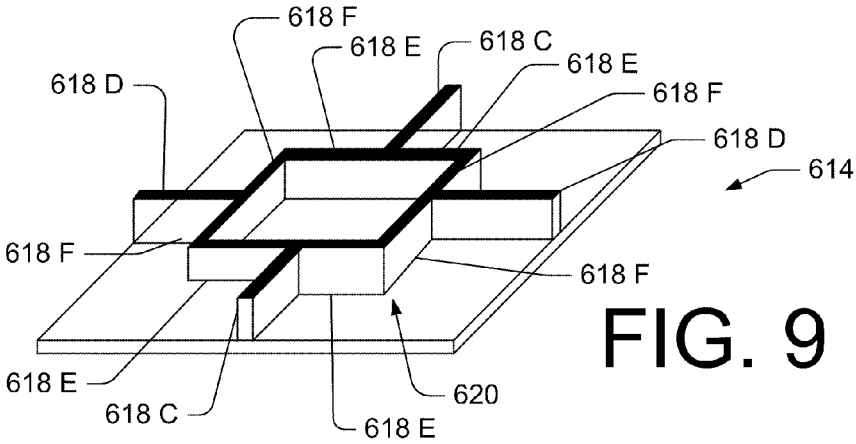
FIG. 9 shows a perspective view of another structured membrane of a CMUT.

With reference to FIGS. 7-9, several structured membranes 610, 612, and 614 for use in CMUTs or elsewhere are illustrated. Structured membranes 610, 612, and 614 can be designed to provide selected resonant frequencies $f_0$ or can be designed to optimize the ratio $f_0/m$ of resonant frequency $f_0$ over mass m. More particularly, structured membranes 610, 612, and 614 can be relatively light and stiff as compared to conventional flexible membrane 110 (see FIG. 4). For instance, structured membranes 610, 612, and 614 can include various features which increase the spring constants k of the structured membranes 610, 612, and 614 while minimizing (reducing or not affecting) the mass m of the structured membrane 610, 612, and 614. As a result, structured membranes 610, 612, and 614 can provide various CMUTs with selected operating frequencies and bandwidths.

The structured membranes 610, 612, and 614 can include plates 616 and one or more beams 618 coupled to the plates 616. It will be understood that the term "plate" used herein in typically refers to a relatively flat member and having a shape which may be rectangular, square, round, etc. In contrast, the term "surface plate" typically refers to a component of an ESCMUT which is usually exposed to the surrounding media and which can be a plate. Beams 618 can extend either entirely or partially across the surfaces of the plates 616 and can be formed from the same material as plate 616 although different materials could be used. In some embodiments, beams 618 can form patterns as discussed further herein. Beams 618 can have thicknesses $t_6$ (or heights depending on the orientation of the structured membrane 610) and widths $w_5$ selected to stiffen the plates 616 thereby altering the spring constants of the structured membranes 610, 612, and 614. The beams 618 can be relatively thin in that the width $w_5$ of the beams 618 can be about equal to, or less than, the thickness t6 of the beams 618. In some embodiments, the width w5 of the beams 618 can be on the same order as the thickness t7 of the plates 616. In some embodiments, the width $w_5$ of the beams can be less than the overall width $w_6$ of the plates 616 and, in some embodiments, much less than the overall width w6 of the plates 616. Furthermore, the thickness $t_6$ of the beams 618 can be greater than the thickness $t_7$ of the plates 616. While FIGS. 7-9 illustrate several beams 618A-618F with similar thicknesses $t_6$ and widths $w_5$, various embodiments provide structured membranes with various beams 618 having differing thicknesses $t_6$, overall widths $w_6$, and lengths. FIGS. 7-9 also illustrate the beams 618 as having rectangular cross sections although beams 618 having other cross sections (e.g., triangular) are within the scope of the disclosure.

FIGS. 7-9 also illustrate that various structured membranes 610, 612, and 614 can have different patterns of beams 618 thereon. For instance, FIG. 7 illustrates a cross pattern with a particular beam 618A extending across the plate 616 in one direction and a second beam 618B extending across the plate 616 in another direction and intersecting beam 618A. FIG. 8 illustrates another embodiment in which a pair of parallel, spaced apart beams 618A extends across the plate 616 and another pair of parallel, spaced apart beams 618B extends across the plate 616 in another direction. While FIGS. 7 and 8 illustrate various beams 618 intersecting at right angles, it will be understood that the beams 618 can intersect at any angle from 0 degrees to 90 degrees without departing from the scope of the disclosure.

FIG. 9 illustrates another pattern of beams 618. More particular, beams 618C and 618D extend only partially across the plate 616. These particular beams 618C and 618D happen to be shown extending from the edges of plate 616. However, various beams 618 can begin, and end, any where on plate 616. For instance, beams 618E and 618F are shown being positioned toward the interior of plate 616 and, as a group, centered on plate 616. Beams 618E and 618F also illustrate that beams 618 can form various structures, such as box 620 on plate 616. Thus, the materials and configurations of the plates 616 and beams 618 can be chosen to result in a structured membrane 610, 612, or 614 having a selected, or optimized, ratio $f_0/m$ of resonant frequency $f_0$ over mass m. Accordingly, the configuration of the structured membrane 610, 612, or 614 can result in a CMUT 100 (see FIG. 1) having a selected, or optimized, operating frequency and bandwidth.

Figure 10:
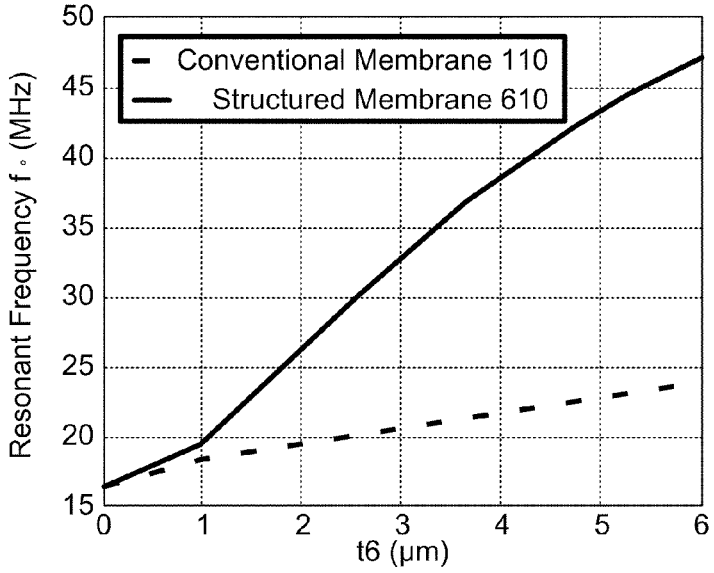
FIG. 10 is a graph showing the resonant frequency of a structured membrane as a function of the thickness of a beam of the structured membrane.

FIG. 10 is a graph showing a comparison of the calculated first resonant frequencies of a flexible membrane 110 shown in and a structured membrane 610 with the enhanced structure shown in FIG. 7. In FIG. 10, the calculated resonant frequency $f_0$ of the structured membrane 610 is plotted as a function of the beam thickness t6. For the various beam thicknesses t6, the thickness of the plate 616 was adjusted so that the equivalent mass of both the membranes 110 and 610 is the same. In the current embodiment, both membranes 110 and 610 are square with overall widths w6 of 30 μm. Additionally, the width $w_5$ of the beams 618 is 1.5 μm. FIG. 10 illustrates that under these conditions, the resonant frequency $f_0$ of the structured membrane 610 increases as the plate thickness $t_7$ increases at a rate approximately four times faster than the resonant frequency $f_u$ of the conventional flexible membrane 110.

Figure 11:
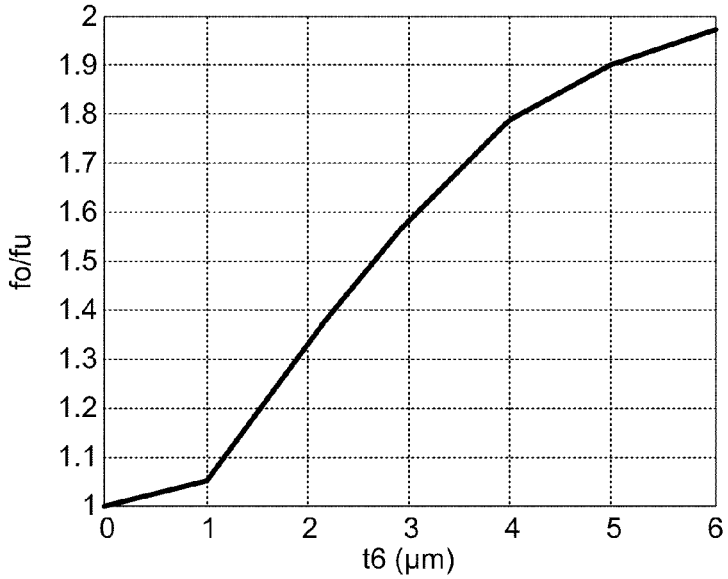
FIG. 11 is a graph showing the ratio of the resonant frequency of a structured membrane over the resonant frequency of a conventional membrane as a function of the thickness of a beam of the structured membrane.

FIG. 11 is a graph showing the ratio $f_o/f_u$ of the resonant frequency $f_o$ of the structured membrane 610 over the resonant frequency $f_u$ of the conventional flexible membrane 110. The data in FIG. 11 is derived from the data in FIG. 10. As shown in FIG. 11, the resonant frequency of the structured membrane can be double the resonant frequency of the conventional flexible membrane 110. This effect is approximately equivalent to multiplying the Young's modulus of the conventional flexible membrane 110 by a factor of 4. In some embodiments, the rate at which the resonant frequency $f_o$ increases and the ratio $f_o/f_u$ of the resonant frequencies can be other values.

Figure 12B:
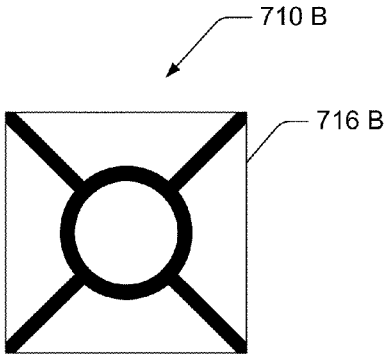
FIG. 12 shows structured membranes of various CMUTs.
Figure 12A:
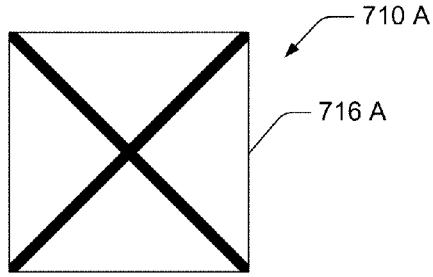
Figure 12D:
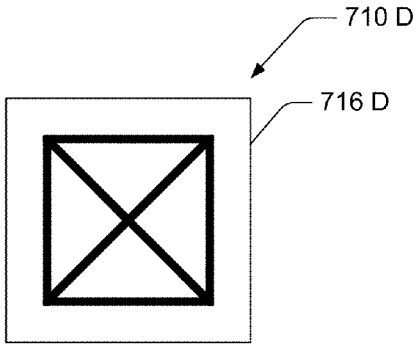
Figure 12C:
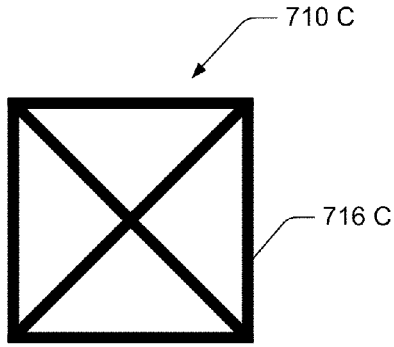

Having seen that enhancing the structure of a CMUT membrane can yield improved frequency response characteristics, additional embodiments of exemplary CMUT membranes will be described herein. More particularly, FIG. 12 illustrates several beam patterns which can be used to enhance the structure of a CMUT membrane to achieve a selected resonant frequency or to optimize the frequency response characteristics of the membrane. For instance, FIG. 12A illustrates a beam pattern in which two beams run catercorner across a square plate 716 to form a structured membrane 710A. In FIG. 12B, the beams of FIG. 12A are shown as having been truncated by a circular beam centered on the plate 716B. FIG. 12C illustrates beams extending catercorner across a plate 716C along with a set of beams extending along the edges of the plate 716C to form a square. A variation on the pattern of FIG. 12C is shown in FIG. 12D in which the beam pattern is reduced in size but remains centered on the plate 716D.

Figure 12F:
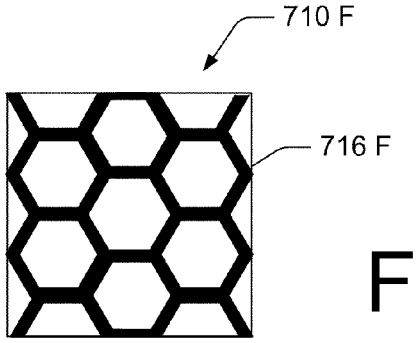
Figure 12G:
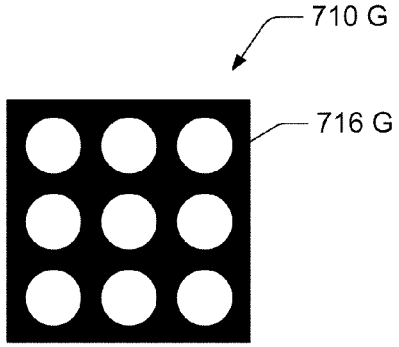
Figure 12E:
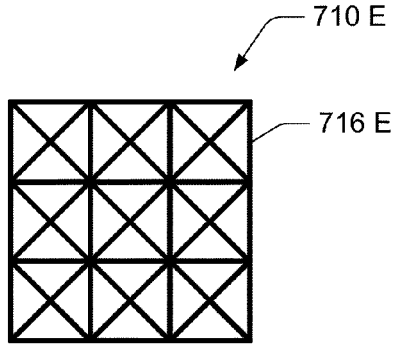
Figure 12H:
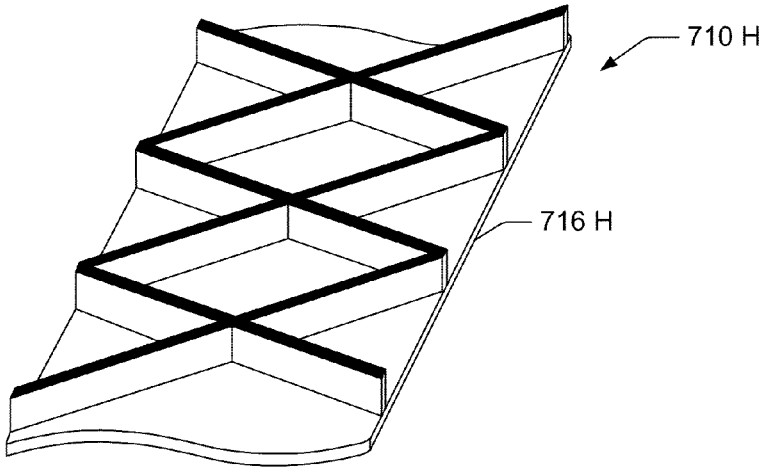
Figure 12I:
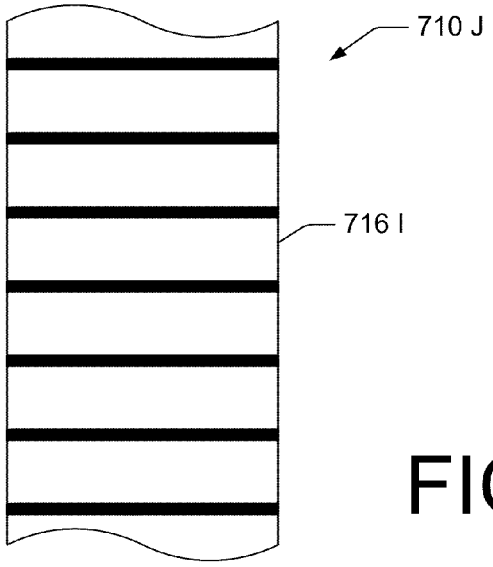
Figure 12J:
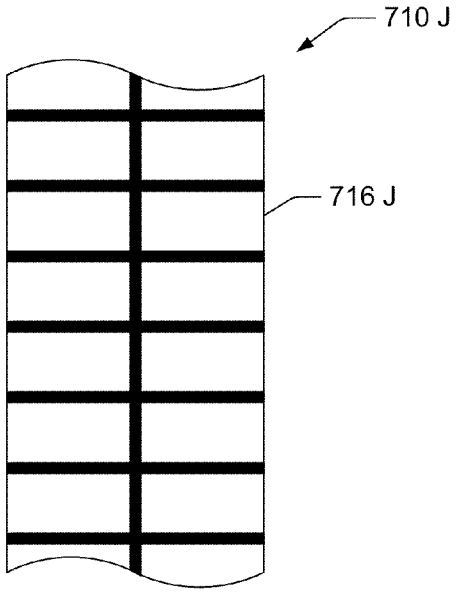

FIG. 12E further shows that various beam patterns (such as the beam pattern of FIG. 12D) can be replicated across the plate 716E to form an array of beam patterns. With reference now to FIG. 12F, a structured membrane 710F with a honeycomb beam pattern is illustrated. Another honeycomb beam pattern is illustrated in FIG. 12G. FIG. 12H illustrates a perspective view of a structured membrane 710H with another beam pattern in which a series of beams crisscross along an elongated plate 716H. FIG. 12I shows another structured membrane 710I in which a series of beams extend across an elongated plate 716I in a direction perpendicular to the direction in which the plate 716I is elongated. Moreover, FIG. 12J illustrates a variation of the beam pattern illustrated in FIG. 12I in which an additional beam extends across the elongated plate 716J in the direction in which the plate 716J is elongated.

Thus various beam patterns are illustrated by FIGS. 7-9 and 12. These exemplary beam patterns are merely illustrative of some of the possible beam patterns and are not intended to be limiting. Moreover, some of the beam patterns shown in FIGS. 7-9 and 12 can be categorized in various non-limiting manners. For instance, the beam patterns illustrated in FIGS. 8, 12E, and 12H-J could be categorized as trellis-like beam patterns. Another non-limiting categorization of beam patterns can be seen with reference to FIGS. 12F-G in which some of the possible honeycomb beam patterns are illustrated.

Figure 13:
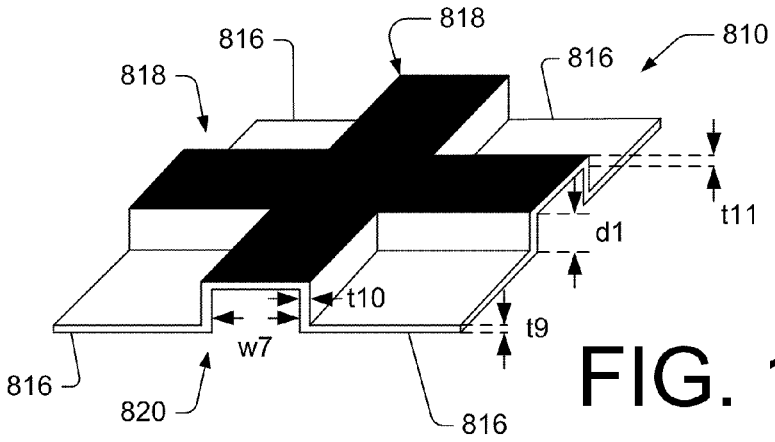
FIG. 13 shows a perspective view of a structured membrane of another CMUT.

With reference now to FIG. 13, a perspective view of a structured membrane 810 for use in CMUTs, and which includes a crenellated profile, is illustrated. Structured membrane 810 includes several plate portions 816 and a pair of channels 818. The channels 818 extend across and join the plate portions 816. The channels 818 are shown as intersecting at the center of the plate portions 816. However the structured membrane 810 can include channels 818 arranged in any desired pattern (see, for example, FIGS. 7-9 and 12). Furthermore, channels 818 define voids 820 with widths $w_7$ and depths $d_1$. While the plate portions 816 can have a uniform thickness $t_9$, the walls of the channels 818 can have thicknesses of $t_{10}$ and $t_{11}$. Thicknesses $t_9$-$t_{11}$ may be the same in some embodiments. Thicknesses $t_9$-$t_{11}$, though, can differ as desired. Thus, while the channels 818 stiffen structured membrane 810 (compared to a flat plate of similar overall dimensions), the voids 820 allow the channels 818 to do so without requiring mass to fill the voids 820. Accordingly, the channels 818 can increase the resonant frequency $f_0$ of the structured membrane 810 with minimal, or no, additional mass thereby providing a significantly increased ratio $f_0/m$ of resonant frequency $f_0$ over mass m.

Figure 14:
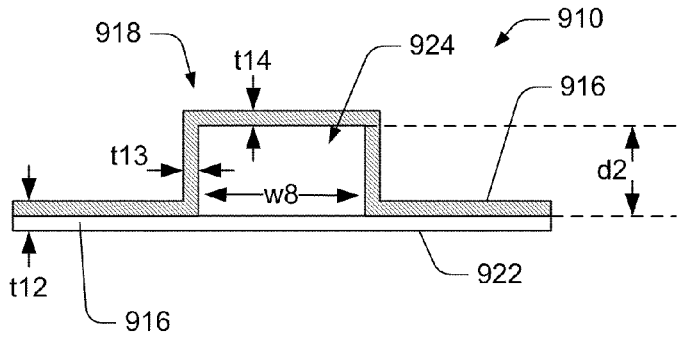
FIG. 14 shows a cross-sectional view of a structured membrane of another CMUT.
Figure 15:
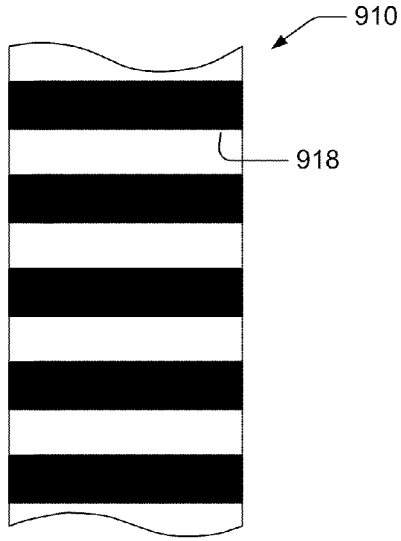
FIG. 15 shows a top plan view of another structured membrane of a CMUT.

With reference now to FIG. 14, another embodiment of a structured membrane 910 is illustrated. Structured membrane 910 includes plate portions 916, a channel 918, and a substrate 922. Substrate 922 can be continuous across the width (and length) of the channel 918 as illustrated. Thus, substrate 922 can enclose a void 924 within channel 918. Structured membrane 910 can have dimensions $t_{12}$-$t_{14}$, $d_2$, and $w_8$ similar to (or differing from) the corresponding dimensions $t_9$-$t_{11}$, $d_1$, and $w_7$ associated with structured membrane 810 of FIG. 13. FIG. 15 illustrates that channels 818 and 918 can be arranged on structured membranes 810 and 910 in patterns such as those illustrated in FIGS. 7-9 and 12. However, as with beams 618, channels 818 and 918 can be arranged in any desired pattern.

Figure 16:
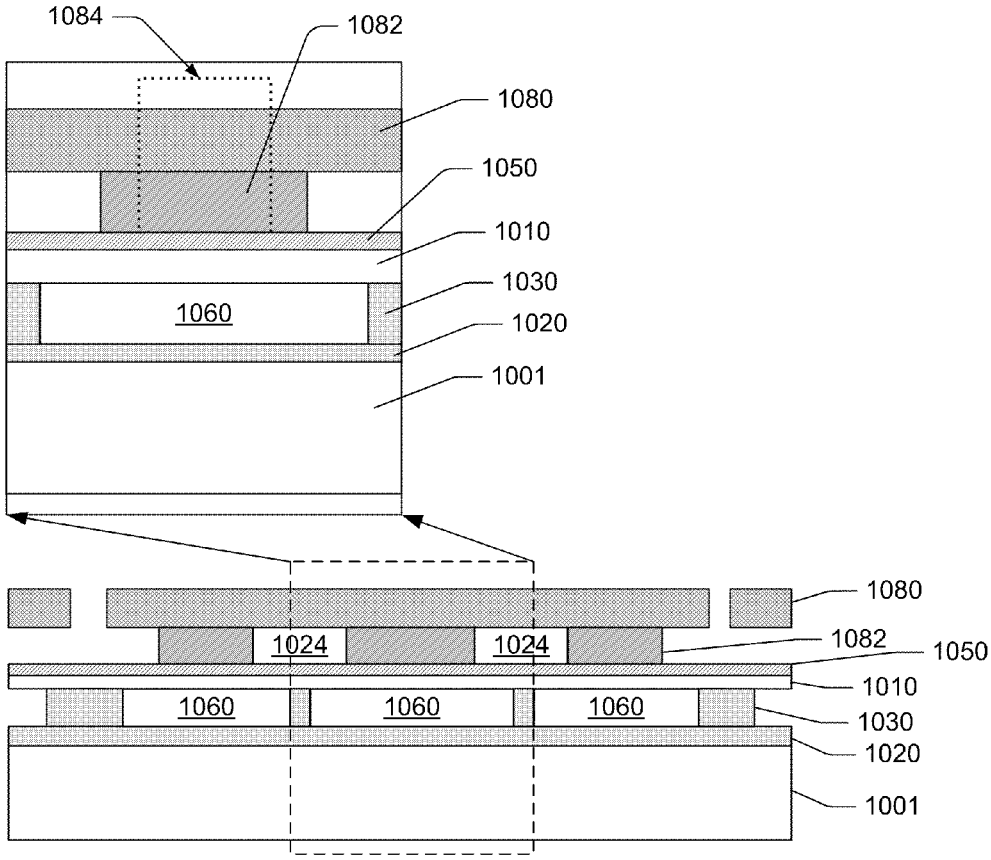
FIG. 16 shows a cross-sectional view of an ESCMUT.

International Patent Application No. PCT/IB2006/052658, entitled MICRO-ELECTRO-MECHANICAL TRANSDUCER HAVING A SURFACE PLATE, by Huang, and which is incorporated herein as if set forth in full, discloses various ESCMUTs with crenellated surface plates similar to the plates described with reference to FIGS. 13-15. FIG. 16 illustrates one embodiment of an array of such ESCMUTs 1000 with an enlarged view therein illustrating one particular ESCMUT 1000 of the array. The ESCMUT 1000 of FIG. 16 includes a substrate 1001, a bottom electrode 1020, at least one spring support 1030, a spring plate 1010, a top electrode 1050, a surface plate 1080, and at least one spring plate connector 1082. The bottom electrode 1020 can be formed on the substrate 1001 or, if the substrate 1001 is conductive, the substrate 1001 can serve as the bottom electrode 1020. The spring supports 1030 can be formed on the bottom electrode 1020 from an insulating material. The spring supports 1030 maintain the spring plate 1010 and top electrode 1050 in spaced apart relationship to the bottom electrode. The spring plate connectors 1082 can be formed on the active areas of the spring plate 1010 (or rather, the top electrode 1050) which lie between the areas of the spring plate 1010 supported directly by the spring supports 1030. Or the spring plate connectors 1082 can be formed on other areas of the spring plate 1010 as desired.

It should be noted, that the active areas of spring plate 1010, which is relatively distant from the spring supports 1030, tend to have the greatest deflection of any area of the spring plate 1010 because they are relatively unconstrained by the spring supports 1030. In contrast, the areas of the spring plate 1010 immediately adjacent the spring supports 1030 can experience little, or no, deflection since the spring supports 1030 hold the spring plate 1010 thereby limiting the motion of the spring plate 1010 in that immediate area. Thus, being coupled to the active areas of the spring plate 1010 by the spring plate connectors 1082, the entire surface plate 1080 can experience a deflection which corresponds to the relatively large deflection of the active areas of the spring plate 1010. Accordingly, ESCMUT 1000 can provide large volumetric displacements and high acoustic efficiency.

Figure 17:
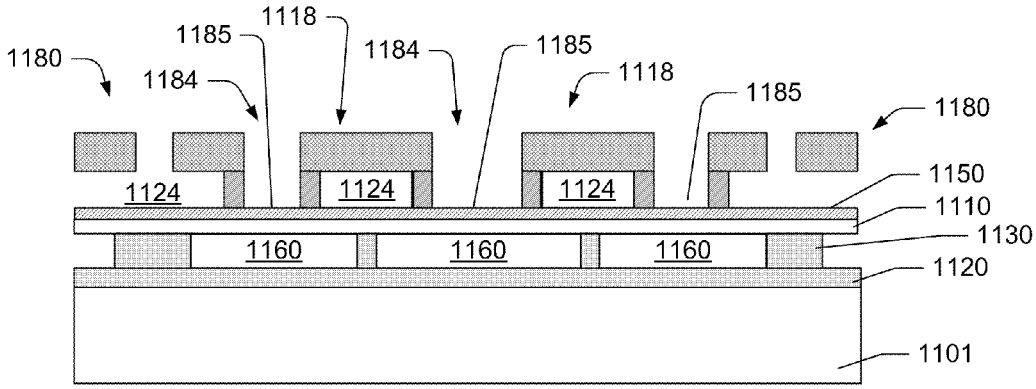
FIG. 17 shows a cross-sectional view of another ESCMUT.

With reference now to FIG. 17, an embodiment of an ESCMUT 1100 with a crenellated surface plate 1180 which can be used where it is desired to have an ESCMUT 1100 with increased displacement and optimized (or selected) frequency response characteristics. More particularly, FIG. 17 illustrates that ESCMUT 1100 can be formed from ESCMUT 1000 (of FIG. 16) by the removal of various portions 1084 from ESCMUT 1000 to form open voids 1184. The removed portions 1084, as illustrated, can include portions of the surface plate 1080 and the spring plate connectors 1082. FIG. 17 also illustrates that the removal of such portions of ESCMUT 1000 creates channels 1118 (with voids 1124) which can be similar to the channels 818 (and voids 820) illustrated in FIG. 13. These channels 1118 can be positioned to straddle the inactive portions of the spring plate 1010 and to couple with, and move with, the active portions of spring plate 1010. As a result, ESCMUT 1100 includes a crenellated surface plate 1180 as defined by the exposed portions 1185 of top electrode 1050 and channels 1118.

With regard to the operation of ESCMUT 1100, the formation of voids 1184 can expose portions 1185 of top electrode 1150. Accordingly, when electrodes 1120 and 1150 displace spring plate 1110, the channels 1118 of surface plate 1180 move a distance approximately equal to the distance which these portions would have moved had the voids 1184 not been formed in ESCMUT 1100. In addition, the exposed portions 1185 of the spring plate 1110 (or rather the top electrode 1150) are displaced according to the electrically generated force developed between the bottom electrode 1120 and the top electrode 1150. Note that, in the absence of the channels 1118 (which can straddle the inactive areas of the spring plate 1110), the inactive portion of the spring plate 1110 would have been relatively static. Thus, the inactive areas of the spring plate 1010 would have contributed little, or no, displacement during the operation of the ESCMUT 1100. Together, though, the displacement of the channels 1118 of surface plate 1180 and the exposed portions 1185 of the spring plate 1110 provide an increased displacement as compared to ESCMUT 1000 of FIG. 16. Accordingly, ESCMUT 1100 can be both acoustically efficient (at least in terms of volumetric displacement) and optimized in terms of the ratio $f_0/m$ of the resonant frequency $f_0$ over the mass m of the surface plate 1180. In the alternative, the ESCMUT 1100 can be acoustically efficient and can possess a selected resonant frequency $f_0$.

Moreover, a third electrode can be attached to the channels 1118 of surface plate 1180 so that it forms another capacitor structure with the electrode 1150. The upper portion of the channels 1118 of the surface plate 1180 can form the third electrode if it is made of a conductive material and the spring plate connector 1182 is made of an insulating material.

Although the subject matter has been described in language specific to structural features and/or methodological acts, it is to be understood that the subject matter defined in the appended claims is not necessarily limited to the specific features or acts described. Rather, the specific features and acts are disclosed as exemplary forms of implementing the claims.

What is claimed is:

1. A capacitive micromachined ultrasonic transducer (CMUT) comprising:

a substrate;

a first electrode coupled to the substrate;

a movable second electrode spaced apart from the first electrode; and a structured membrane coupled to the movable second electrode, the structured membrane having a base portion and a structured portion, the base portion comprising a flat member, the structured portion including a feature formed across at least part of the base portion so that a ratio of a spring constant of the structured membrane over a mass of the structured membrane is greater than a ratio of a spring constant of the base portion over a mass of the base portion.

2. The CMUT as recited in claim 1, wherein the base portion of the structured membrane and the structured portion of the structured membrane are integrally made from a same material.

3. The CMUT as recited in claim 1, wherein the structured portion of the structured membrane is separately added onto the base portion of the structured membrane.

4. The CMUT as recited in claim 1, wherein the flat member of the base portion of the structured membrane comprises a plate and the feature of the structured portion of the structured membrane comprises a first beam coupled to the plate.

5. The CMUT as recited in claim 4, wherein the feature of the structured portion of the structured membrane further comprises a second beam coupled to the plate and intersecting the first beam.

6. The CMUT as recited in claim 4, wherein the first beam extends partially across the plate.

7. The CMUT as recited in claim 4, further comprising the first beam defining a void.

8. The CMUT as recited in claim 4, wherein the plate and the first beam are a same overall shape.

9. The CMUT as recited in claim 4, wherein a thickness of the first beam is greater than a thickness of the plate.

10. The CMUT as recited in claim 4, wherein a thickness of the first beam is greater than a width of the first beam.

11. The CMUT as recited in claim 4 wherein the first beam includes a channel.

12. The CMUT as recited in claim 1, wherein the CMUT is an embedded spring CMUT (ESCMUT) and the structured membrane is a surface plate.

13. A capacitive micromachined ultrasonic transducer (CMUT) comprising:

a substrate;

a first electrode coupled to the substrate;

a movable second electrode spaced apart from the first electrode; and a structured membrane coupled to the movable second electrode, the structured membrane including a plate and a first beam coupled to the plate and being shaped to result in an effective ratio of a resonant frequency of the structured membrane over a mass of the structured membrane greater than a ratio of a resonant frequency of the plate over a mass of the plate.

14. The CMUT as recited in claim 13, further comprising a second beam coupled to the plate, the second beam intersecting the first beam.

15. The CMUT as recited in claim 13, wherein the first beam extends partially across the plate.

16. The CMUT as recited in claim 13, wherein the first beam includes a channel.

17. The CMUT as recited in claim 13, wherein the plate and the first beam are a same overall shape.

18. The CMUT as recited in claim 13, wherein a thickness of the first beam is greater than a thickness of the plate.

19. The CMUT as recited in claim 13, wherein a thickness of the first beam is greater than a width of the first beam.

20. A capacitive micromachined ultrasonic transducer (CMUT) comprising:

a substrate;

a first electrode coupled to the substrate;

a movable second electrode spaced apart from the first electrode; and a structured membrane coupled to the movable second electrode and including:

a plate, a first beam coupled to the plate and defining a void, and a second beam coupled to the plate and intersecting with the first beam, the structured membrane being shaped to result in an effective ratio of a resonant frequency of the structured membrane over a mass of the structured membrane greater than a ratio of a resonant frequency of the plate over a mass of the plate.

21. An embedded spring CMUT (ESCMUT) comprising:

a substrate;

a first electrode coupled to the substrate;

a spring plate coupled to and spaced apart from the first electrode;

a movable second electrode coupled to the spring plate; and a structured surface plate coupled to the second electrode and having a base portion and a structured portion, the base portion comprising a flat member, the structured portion including a feature formed across at least part of the base portion so that an effective ratio of a resonant frequency of the structured surface plate over a mass of the structured surface plate is greater than a ratio of a resonant frequency of the base portion over a mass of the base portion.

22. The ESCMUT of claim 21 wherein the feature of the structured portion includes a channel.

23. The ESCMUT of claim 22 wherein the second electrode has an active area and an inactive area, the channel spanning the inactive area.

24. The ESCMUT of claim 22 further comprising a spring plate connector coupling the structured surface plate to the second electrode, the spring plate connector and the channel being fabricated from a same material.

25. The ESCMUT of claim 21 further comprising a third electrode coupled to the structured surface plate.

26. The ESCMUT of claim 25 wherein:

the feature of the structured portion includes a channel;

the third electrode is coupled to the structured portion at the channel;

the first electrode and the second electrode form a first capacitor structure; and the third electrode and the second electrode form a second capacitor structure.

27. The ESCMUT of claim 25 wherein:

the feature of the structured portion includes a channel;

a portion of the channel is the third electrode;

the ESCMUT further comprises a spring plate connector coupling the structured surface plate to the second electrode;

the spring plate connector is fabricated from an insulating material; and the third electrode is fabricated from a conductive material.

28. The ESCMUT of claim 22 further comprising a spring plate connector coupling the structured surface plate to the second electrode, the spring plate connector and the channel being fabricated from differing materials.

* * * * *